United States Patent [19]

Perron et al.

[11] 4,031,434

[45] June 21, 1977

[54] KEYHOLE-LESS ELECTRONIC LOCK

[75] Inventors: Robert Richard Perron, Beverly; John E. Trombly, Winchester, both of Mass.

[73] Assignee: The Eastern Company, Naugatuck, Conn.

[22] Filed: Dec. 29, 1975

[21] Appl. No.: 644,947

[52] U.S. Cl. ..... 361/172; 70/277
[51] Int. Cl.² ..... E05B 47/00
[58] Field of Search ..... 317/134; 340/274 C, 340/147 F, 147 MD; 318/162; 70/277, 278

[56] References Cited

UNITED STATES PATENTS

| | | | |
|---|---|---|---|
| 3,885,408 | 5/1975 | Clark, Jr. | 317/134 X |
| 3,953,769 | 4/1976 | Sopko | 317/134 |

*Primary Examiner*—R. N. Envall, Jr.

[57] ABSTRACT

An inductively coupled electronic lock system wherein a key unit receives binary multiple bit data and generates a binary frequency modulated carrier which is input to a transmitter inductor. A lock unit of the system has an inductive pick-up which compares the received sequence of binary signals with a predetermined sequence of binary signals so that upon a proper correspondence a motor opens the lock.

6 Claims, 3 Drawing Figures

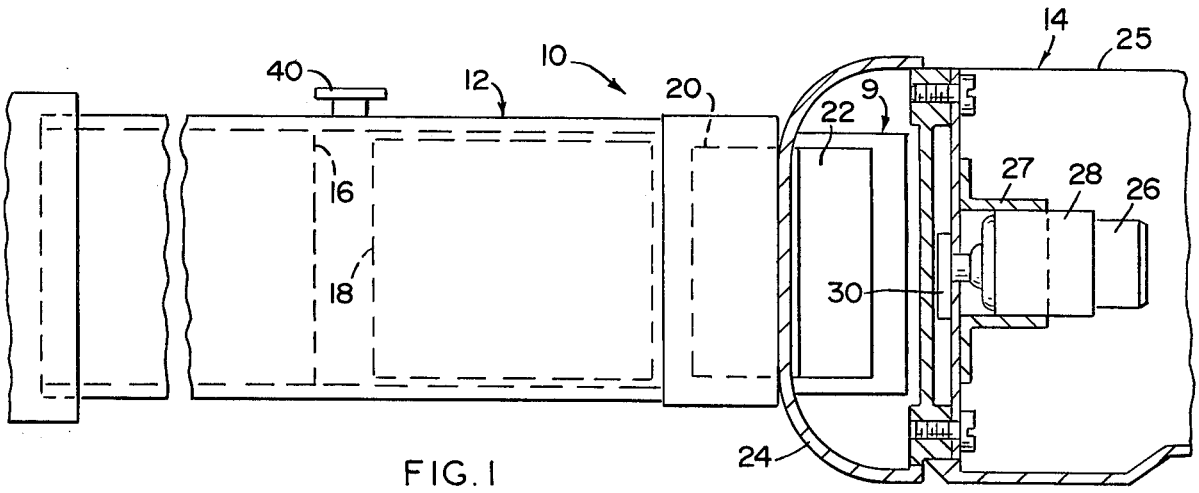
FIG. 1
FIG. 2
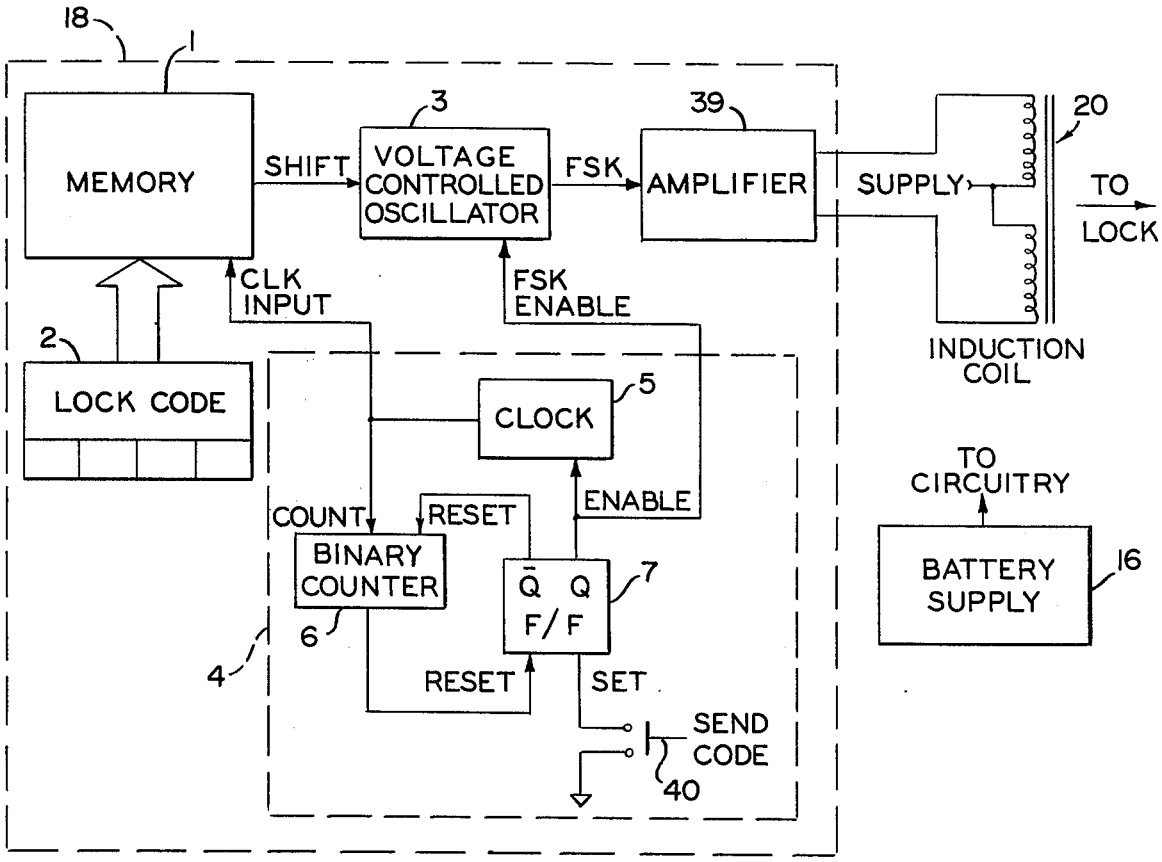

KEYHOLE-LESS ELECTRONIC LOCK

BACKGROUND OF THE INVENTION

1. Field of the Invention

An inductively coupled lock with a key providing a binary signal to the lock which responds only to a specific signal in opening the lock.

2. Description of the Prior Art

Electronic lock systems are well known in the prior art. These take various forms. Generally, the key or a coded device is placed within an aperture in the lock portion of the system. The lock is designed to then discriminate against all but a predetermined code. In the specific case of electronic locks, the key is encoded in any number of ways. Some prior art encoding techniques include the provision of punched holes which correspond to electrical probes within the lock. Conductive strips are also utilized, which complete the electrical circuit with the lock. Other methods include an electromagnetic code on the key which is discerned by cooperating circuitry within the lock.

One type of electronic lock system known in the prior art has a key comprising a coil. When the key is placed in close proximity to the lock, a resident circuit within the lock itself is completed causing the lock to open.

These systems are complex and can be costly to construct and maintain. The advantages of electronic locks are many and well known. However, there are certain disadvantages in the presently known electronic lock systems.

First, the electronic lock requires a source of electricity. A number of present art locks have the power source within the lock portion of the system. This is frequently inconvenient and impractical for certain applications where the lock itself is inaccessable to a power source.

Many presently known electronic lock systems are generally designed to have a large number of replaceable or recodeable keys capable of fitting a relatively small number of locks. These locks have the sophisticated mechanisms contained within them along with a power source. This is inconvenient and impractical in cases where one key can fit many locks and the locks themselves are subject to severe abuse and located in places inaccessable to a power supply.

Another problem commonly associated with electronic systems is that the receiving aperture in the lock for the key is subject to tampering. The insertion of foreign material into the receiving aperture of a sophisticated electronic lock could severely damage or destroy many conventional electronic locks by fouling contacts or destroying electromagnetic sensors. Any lock used in a public place is subject to such destructive tampering.

Another problem encountered with transmitting an electrical signal from the key to the lock is that in using a unique waveform, the number of different types of waveforms which can be used are greatly limited. Furthermore, where part of the electronics are analog, such as the shape and magnitude of the waveform, the long term stability of the circuitry may require periodic adjustment.

Therefore, in view of the many problems existing in the lock industry, it can be seen that there is a need for an electronic lock system wherein the lock part is simple to construct, requires no built in power source, is relatively tamperproof, has a very large number of combinations of predetermined signals that can be used to activate the lock and contains no circuitry with long term stability problems. The key part of such a desirable system could contain the power source for lock operation and be capable of opening the lock without being inserted in an aperture of the lock.

SUMMARY OF THE INVENTION

The present invention comprises an inductively coupled binary lock system wherein the key transmits a series of binary signals with the use of a frequency modulated carrier wave to the lock. The lock, on receiving a predetermined sequence of binary signals, will open the locking bolt.

The key unit comprises a memory register which stores an alterable multiple bit key code. This key code is converted by a voltage controlled oscillator to a binary frequency shift keyed carrier. After amplification, the carrier is transmitted from the key by magnetic induction to the lock.

The lock unit comprises a receiving inductor and a frequency shift keying receiver which converts the frequency modulated carrier back to binary pulses of multiple bit data. This binary data comprising the key code is stored in a memory register where it will be compared in a comparator means with a predetermined master code stored in a reprogramable memory register. In the event that there is a proper correspondence of the compared codes the lock motor is activated to run in a direction to open the lock.

There is no specific need for an aperture for the primary operation of the lock system, wherein such aperture can be damaged by attempts to defeat the lock. In the preferred embodiment there is no internal power supply in the lock itself so that location of the lock remote from a power source is of no concern. The lock is of relatively simple construction and thus many locks can be built for operation by a single key.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature and objects of the invention reference should be had to the following detailed description taken in connection with the accompanying drawings in which:

FIG. 1 is a cross-sectional view of the key and the lock interrelated together to operate the locking mechanism.

FIG. 2 is a circuit diagram of a component of the key.

Similar characters refer to similar parts throughout the several views of the drawings.

DETAILED DESCRIPTION

Figure 3:
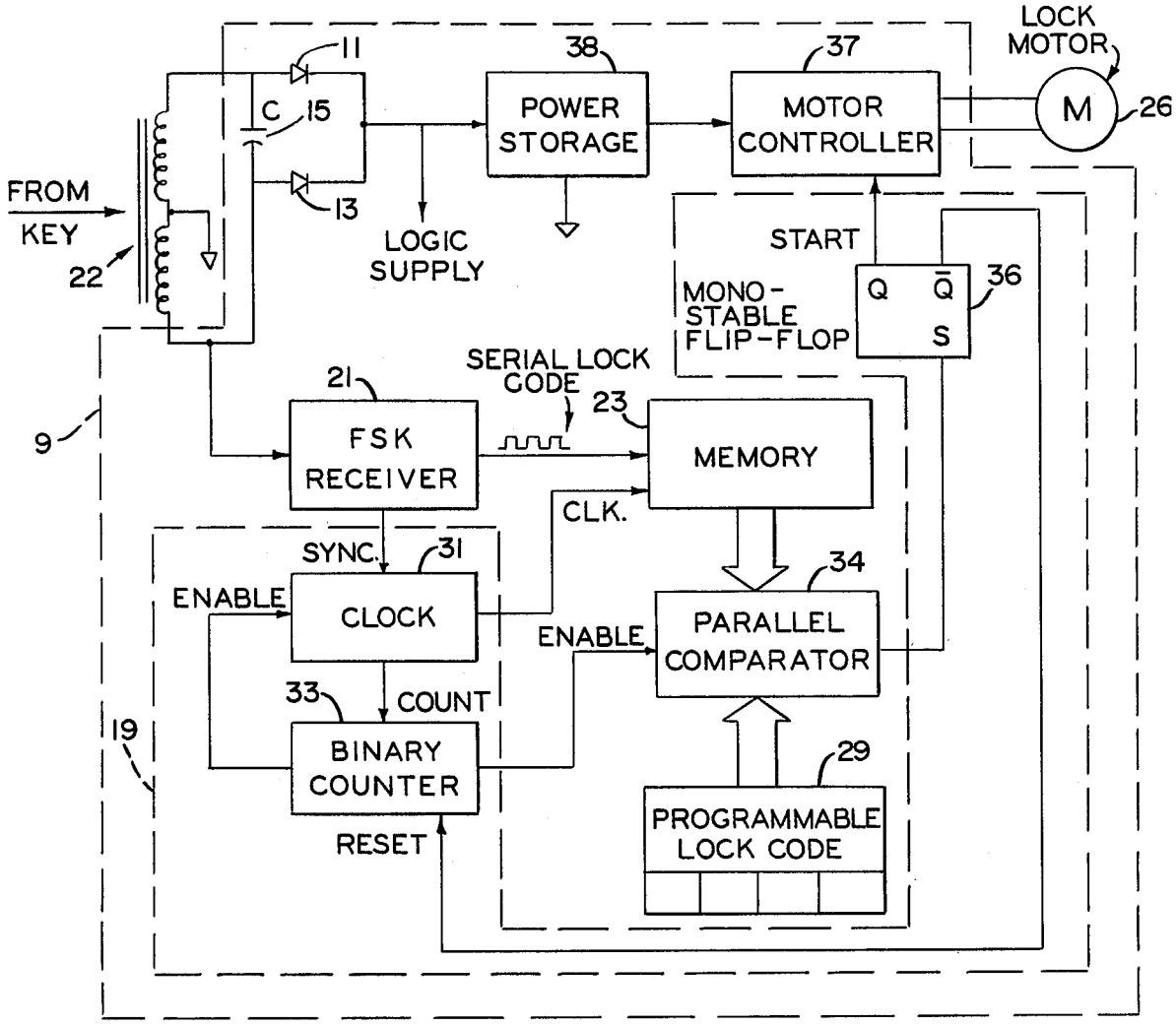
FIG. 3 is a schematic diagram of the electronic circuitry contained within the lock.

The electronic lock system of the present invention is shown in FIG. 1 and generally represented as 10. Key means 12 is shown in operating position with relation to lock means 14.

Key means 12, in FIG. 1 is shown containing power supply means 16, generating means 18 and key inductor means 20. Preferably, power supply 16 may comprise a dry cell battery element or other appropriate DC power source. Switch means 40 on key means 12 is used to open or close the lock. The lock means generally indicated as 14 is shown comprising outer casing means 24 and 25. Internal to the casing means 24 and 25 is lock inductor means 22, signal distinguishing means 9, motor means 26, gear means 28 and lock lug means 30. Motor means 26, gear means 28, and lock lug means 30 are connected to casing means 24 and 25 by appropriately configured bracket 27 or applicable connector means. Upon a voltage of a correct polarity, motor means 26 will rotate gear means 28. Gear means 28 engages lug lock means 30 so as to withdraw lock lug means 30 from a lock to an unlocked position.

FIG. 2 is a circuit diagram of the generating means 18 and key inductor means 20, all incorporated in key means 12. Power to drive the generating means is derived from power source means 16. The generating means 18 comprises first memory means 1, fixed code means 2, voltage control oscillator means 3, first amplified means 39 and first logic means 4.

In the preferred embodiment, a lock code composed of multiple bit data is loaded in parallel into the first memory means 1 by way of a fixed code means 2. Fixed code means 2 takes the form of either a small plug-in circuit or a dialable and readily reprogramable switch. Energized by power supply means 16, first memory means 1 is capable of storing a predetermined number of data bits which comprise the key code and is typically a shift register capable of a parallel-to-serial conversion of multiple bit data. However, multiple bit data could be received in serial from first code means 2 which would eliminate the need for first memory means 1 to have conversion capacity.

The serial output of first memory means 1 is input to a voltage controlled oscillator means 3, whereby the first memory means 1 shifts the frequency of the oscillator means 3 from $f_1$ to $f_2$, depending on whether the serially coded register output is the digit 1 or the digit 2. The output of oscillator means 3 comprising a binary frequency modulated carrier is input to first amplifier means 39. First amplifier means 39 output means is electrically connected to key inductor means 20.

Timing of the operation and timing of the key means is accomplished by first logic means 4 comprising first clock or fixed frequency pulse generator means 5, binary counter means 6, first flip-flop or bistable multivibrator means 7, and switch means 40. The code transmission is initiated when switch means 40 is depressed. Switch means 40 sets first flip-flop means 7 in a conducting state. This enables simultaneously both the clock means 5 and the oscillator means 3. First clock means 5 output is electrically connected to memory means 1 and also to binary counter means 6 so that both can receive as input clock pulses. Clock pulses are used for shifting data out of memory means 1 and with each clock pulse sent to the memory means 1, the counter means 6 counts the pulse. After the serial code of memory means 1 has been completely dumped and all bits shifted out have been counted the counter means 6 resets the first flip-flop means 7 to a non-conducting state and in turn first flip-flop means 7 resets the binary counter means 6 back to zero.

Upon application of voltage from the power source means 16, oscillator means 3 operates at its normal frequency $f_0$, a frequency which is mid-way between $f_1$ and $f_2$. Depressing the switch means 40 results in the key code being transmitted in frequency shift keying by the oscillator means 3 which drives the first amplifier means 39 and induction coil means 20. Upon completion of the key code transmission the oscillator means continues to transmit at $f_0$ until power source means 16 is turned off. This results in the continuation of power being sent to the normally passive circuitry of key means 12 so that the motor means 26 has sufficient time, a few seconds, to drive the lock open by use of cam means 30.

The lock inductor means 22 receives the signals conveyed by magnetic induction from key inductor means 20. If the coupling between the key means 12 and lock means 14 is to be made through a section of sheet metal, then the metal should preferably be non-magnetic and have a relatively low value of electrical conductance to minimize eddy current losses. Under these conditions the center frequency $f_0$ can be in the range of 50 to 5000 Hz. If the electromagnetic energy transmitted between the key means 12 and lock means 14 is transmitted through a non-metallic plastic-type material, then the center frequency $f_0$ can be extended well beyond 5000 Hz because the penetration of the electromagnetic energy is not limited by either the permeability or the essentially zero electrical conductance of the plastic-type material.

FIG. 2 is a circuit diagram of the signal distinguishing means 9, motor means 26, and centertapped lock inductor means 22, all incorporated in lock means 12. Signal distinguishing means 9 comprises capacitor means 15, first and second diode means 11 and 13, frequency key shifting receiver means 21, second memory means 23, second logic means 19, power storage means 38 and motor controller means 37.

The AC signal output of centertapped lock inductor means 22 are input to first and second diode means 11 and 13 to generate a DC supply of power for power storage means 38 and signal distinguishing means 9. Finally, AC signal output of inductor means 22 is input to the frequency shift keying receiver means 21.

Power storage means 38 is connected to the input of motor controller means 37. Motor controller means 37 can comprise of a bridge driver so that upon receiving a signal the polarity across the motor means 26 is reversed. By reversing the polarity the motor means 26, which was running in a direction to keep the lock closed, it now runs in the opposite direction to open the lock. Another design of the motor controller means 37 could consist of a simple switch, which upon receiving a signal would complete the circuit to said motor means 26.

After receipt of a signal to activate the motor means 26, power of the right polarity is transferred to run motor means 26 in a direction to open the lock.

Capacitor means 15 is inserted to provide sufficient resonance to lock inductor means while at the same time smoothing the transmitted signals. The centertapped inductor means 22 is tuned with capacitor means 15 to the frequency $f_0$ transmitted by the key inductor means 20. The Q of the resonant circuit, i.e., the sharpness of the resonance curve, is chosen such that the frequencies $f_1$ and $f_2$ of the transmitted signal fall on the upper portion of the skirts of the resonance curve. The frequency $f_0$ is chosen such that the bandwidth requirements are met for transmitting the 16 bit data stream of the frequency shift keying code, and that the skin depth of the electromagnetic energy is sufficient to transmit the signal through at least one-sixteenth to one-eighth inch of non-magnetic stainless steel or other essentially non-magnetic material having poor electrical conductivity such as filled plastics, etc.

Receiver means 21 converts the output of inductor means 22 consisting of a binary frequency modulated carrier wave to electrical pulses of binary bit data comprising the key code. This multiple bit data is input to second memory means 23 which is typically a shift register capable of serial to parallel conversion of the multiple bit data. However, second memory means 23 could consist of a read only memory capable of storing a predetermined number of data bits and having output of serial data bits.

The output of second memory means 23 is coupled to a comparator means 34 which also receives as input a master code from a programable lock code means 29.

The comparator means 34 operates so as to compare the multiple bit data specifying the key code with the master code. Typically, memory means 23 has a parallel multiple bit data output, and only one comparison of entire key code will be made at one time with the master code. However, with a serial output of second memory means 23, the comparison of the key code with the master code can be accomplished on a bit by bit basis.

Second logic means 19 controls the operation and timing of the lock means 14 and comprises second clock means 31, second binary counter means 33, and second flip flop means 36. Second clock means 31 has an input connected to the receiver means 21 so that clock means 31 receives a synchronization pulse and has an output connected to second memory means 23 so as to provide for clock pulses. Having been synchronized with the serial output of receiver means 21, second clock means 31 provides clock pulses for ordering and arranging the incoming serial data bits in second memory means 23. Second counter means 33 has an input connected to the second clock means 31 so as to receive and count clock pulses and has an output connected to the comparator means 34 so as to enable comparator means 34. The second counter means 33 will, upon receipt of the entire key code, by the memory means 23, enable comparator means 34 for its single comparison. If upon comparison between the key code and master code, there is correspondence of all bits, comparator means will provide an output signal which sets second flip flop means 36 to a conductive state. If upon comparison between the key code and master code, there is no correspondenc of all bits, second flip-flop means 36 is not set and second binary counter 33 disables second clock means 31, preventing other key codes from being loaded into second memory means 23.

Motor controller means 37 includes a bridge driver so that upon setting second flip flop means 36 to a conductive state an electrical signal will reverse the polarity across the motor means 26. The motor means 26 which had been rotating in a direction so that the lock remains closed, will now rotate in the opposite direction causing the lock to open. In its conductive state, flip flop means 36 also sends an output signal to the input of second counter means 33 which sets second counter means 33 back to zero.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all the generic and specific features of the invention, which, as a matter of language, might be said to fall therebetween.

Now that the invention has been described,

What is claimed is:

1. An electronic lock system comprising, in combination: key means including generating means for generating a plurality of binary frequency modulated carrier waves, first inductor means electrically connected to said generating means; lock means including lock inductor means positioned to inductively couple with said key inductor means when said key means is in predetermined spatial relation to said lock means, signal distinguishing means electrically connected in circuit of said lock means and disposed to receive signals from said generating means whereby a predetermined sequence of binary signals is compared with the sequence of binary signals contained within the carrier from said generating means, motor means electrically connected in driven relation to said signal distinguishing means so that upon a corresponding comparison of said signal distinguishing means said motor means is activated, lock lug means connected in movable, driven relation to said motor means, whereby activation of said motor means causes movement of said lock lug means between a locked and unlocked position.

2. An electronic lock system as in claim 1 wherein said generating means further comprises first memory means operative to store an electrically alterable multiple bit key code, oscillator means connected to the output of said first memory means so that binary electrical pulses comprising the key code are converted to an output of a binary frequency-modulated carrier wave, first amplifier means providing amplification of carrier having an input connected to output of said oscillator means, said first amplifier means having an output and input connected to said key inductor means, and first logic means having two outputs with one output to said first memory means and another output to said oscillator means, whereby said first logic means controls timing of transfer of binary data to said oscillator means and enables oscillator means.

3. An electronic lock system as in claim 2 wherein said first logic means further comprises first clock means having output connected to said first memory means, whereby said first clock means provides clock signal to said first memory means for shifting data bits of the key code to said oscillator means, first binary counter means connected to output of said clock, whereby first counter means counts clock pulses and first flip flop means including start switch with said first flip flop means having one input connected to said first counter means and three outputs with one electrically connected to first counter means and another connected to said first clock means and the final one connected with said oscillator means, whereby setting said first flip flop means with said switch means enables said oscillator means and said clock means and after all data bits have been shifted from said first memory means counter means resets said first flip-flop with said first flip flop in turn resetting said first counter means to zero.

4. A lock system as in claim 2 wherein said signal distinguishing means further comprises capacitor means connected across said second inductor means so as to provide sufficient reasonance and to smooth transmitted signals, first and second diode means connected to said lock inductor means to generate a direct current supply of power to said lock means, receiver means connected to output of said lock inductor means so that the carrier wave comprising the key code is received and converted to a binary electrical pulse signal; second memory means having input connected to the output of said receiver means so as to receive and store the key code, programable code memory means having stored therein master lock code, comparator means being operative to provide an output signal upon receipt of the key code from said second memory means corresponding to said master lock code received from said programable code memory means, power storage means connected to the output of first and second diode means, whereby said power storage means stores sufficient energy to operate said motor means, motor controller means having input connected to said power storage means and having input and output connected to said motor means, whereby said motor controller means upon receipt of a trigger signal activates said motor means, second logic means having input connected to receiver means and three outputs with one connected to said second memory means and another connected to said comparator means and the last one connected to said motor controller means, whereby said second logic means provides timing for the ordering of multiple bit data in said second memory means and enables said comparator means and upon receipt of signal from said comparator means sends a trigger signal to said motor controller means.

5. A lock system as in claim 4 wherein said second logic means comprises second clock means having input connected to said receiver means so that said second clock means receives a synchronization pulse and output connected to said second memory means for providing a clock pulse to order multiple bit data within said second memory means, second counter means having input connected to said second clock means so as to receive and count clock pulses and output connected to said comparator means so as to enable comparator means, and second flip flop means having input connected to said comparator means and two outputs with one connected to said motor controller means and the other connected to said second counter means, whereby upon receipt of signal from said comparator means of a corresponding code comparision said second flip-flop will be reset so as to send a triggering signal to said motor controller means and a triggering signal to said second counter means for resetting said second counter means to zero.

6. A lock system as in claim 5 wherein said second counter means has an output connected to the input of said second clock means, whereby upon lack of correspondence between the key code and the master code said second counter disables second clock means.

* * * * *